United States Patent [19]

Gasparrini

[11] 4,123,972

[45] Nov. 7, 1978

[54] POSITIONING MECHANISM FOR LOCATING THE EDGE OF AN INK METERING MEANS

[75] Inventor: C. Robert Gasparrini, Rye, N.Y.

[73] Assignee: Baldwin-Gegenheimer Corporation, Stamford, Conn.

[21] Appl. No.: 796,184

[22] Filed: May 12, 1977

[51] Int. Cl.[2] ..... B41F 31/04; B41F 31/06

[52] U.S. Cl. ..... 101/363

[58] Field of Search ..... 101/365, 363, 364, 350, 101/157, 169, 207, 208, 210; 33/182

[56] References Cited

U.S. PATENT DOCUMENTS

| | | | |
|---|---|---|---|
| 367,526 | 8/1887 | Jaeck | 101/365 |
| 828,667 | 8/1906 | Kathe | 101/365 |
| 1,275,348 | 8/1918 | Wood | 101/365 |
| 1,574,474 | 2/1926 | Faltus | 101/365 |
| 2,451,634 | 10/1948 | Ranger | 101/364 |
| 2,514,556 | 7/1950 | Peyrebrune et al. | 101/364 |
| 2,627,230 | 2/1953 | Huck et al. | 101/415.1 |
| 2,887,049 | 5/1959 | Mueller | 101/364 |
| 3,559,573 | 2/1971 | Hantscho | 101/365 |
| 3,566,787 | 3/1971 | Moos | 101/363 |
| 3,699,888 | 10/1972 | Easoz | 101/365 |
| 3,895,575 | 7/1975 | Cappel et al. | 101/365 |
| 3,921,525 | 11/1975 | D'Amato et al. | 101/365 |
| 3,978,788 | 9/1976 | Cappel et al. | 101/365 |

*Primary Examiner*—J. Reed Fisher

[57] ABSTRACT

A positioning mechanism for locating the edge of an ink metering means with respect to the ink fountain roller of a printing press. The positioning mechanism includes a metering means support block which is pivotally mounted to the press frame and on which the metering means is mounted. There is a torsion bar to which are keyed a first lever means. The first lever means is pivotally connected to a second lever means. The second lever means is also pivotally connected to the press frame. The torsion bar has mounted thereon a worm gear which is in mesh with a worm operated by a handle to cause pivotal movement of the metering means support block. The ink metering means support block has stop means thereon in the form of curved surfaces or cheeks. The curved surfaces or cheeks directly engage the ink fountain roller to precisely position the metering means with respect to the ink fountain roller.

6 Claims, 3 Drawing Figures

POSITIONING MECHANISM FOR LOCATING THE EDGE OF AN INK METERING MEANS

BACKGROUND OF THE INVENTION

This invention relates to a positioning mechanism for printing presses and more particularly to a positioning mechanism for locating a metering means with respect to an ink fountain roller wherein the mounting member for the metering means directly engages the fountain roller of the printing press to accurately position the metering means with respect to the ink fountain roller.

It is essential in order to obtain proper ink coverage that the metering means be accurately positioned with respect to the fountain roller. Moreover, it is important that the positioning be accompanied simply and expeditiously.

In the past the metering means has been positioned with respect to the ink fountain roller in a variety of ways. In some instances where the metering means is a continuous blade, the blade is positioned by individual spaced apart screws which engage the metering means. In other instances individual cams or the like are used to position separate metering means segments.

BRIEF DESCRIPTION OF THE INVENTION

The present invention relates to a positioning mechanism for a metering means for a printing press which locates the edge of the metering means very accurately with respect to the fountain roller. The invention eliminates variations in metering due to roller movement within the roller bearings or the eccentricity of the roller in its bearing journals. The invention provides a repeatable relationship between the position of the metering means edge and the ink film thickness on the fountain roller and also provides the capability of metering very thin ink films without contact between the metering means edge and the fountain roller surface.

The invention achieves the foregoing advantages with a relatively simple mechanical construction and it is not necessary to resort to complex and/or expensive structures or processes.

The mechanism of the present invention includes in a preferred embodiment a metering means supporting block on which the metering means is mounted. The metering means supporting block is pivotally mounted on the press frame for movement towards and away from the ink fountain roller.

The metering means supporting block includes stop means which directly engages the ink fountain roller of the printing press so as to position the edge of the metering means with respect to the ink fountain roller.

The stop means is in the form of curved surfaces which conform to the curvature of the ink fountain roller. The curved surfaces are sometimes referred to herein as cheeks.

There are means provided for causing the pivotal movement of the metering means assembly support blocks with respect to the ink fountain roller which in turn will cause precise positioning of the metering means assembly. The means for causing movement of the metering means support block includes means for urging the stop means into continued engagement with the ink fountain roll.

OBJECTS

It is an object of this invention to provide a new and improved positioning mechanism for precisely locating the edge of an ink metering means with respect to an ink fountain roller.

Another object of this invention is to provide a positioning mechanism for directly positioning an ink metering edge with respect to an ink fountain roller.

A further object of this invention is to provide a supporting member for an ink metering means which comes into close proximity with the ink fountain roller to precisely position the edge of the ink metering means with respect to the ink fountain roller.

Another object of this invention is to provide a positioning mechanism for an ink metering means wherein the mounting means for the metering means directly engages the ink fountain roller and is constantly urged towards the ink roller to maintain the ink metering edge in position.

Additional objects and advantages of the invention will be set forth in the description which follows and, in part will be obvious from the description, the objects and advantages being realized and obtained by means of the instrumentation, parts, apparatus and elements being particularly pointed out in the appended claims.

The invention consists of the novel parts, steps, constructions and improvements shown and described.

The accompanying drawings which are incorporated in and constitute part of this specification illustrate an embodiment of the invention and together with the description serve to explain the principles of the invention.

OF THE DRAWINGS

DETAILED DESCRIPTION OF THE INVENTION

Figure 1:
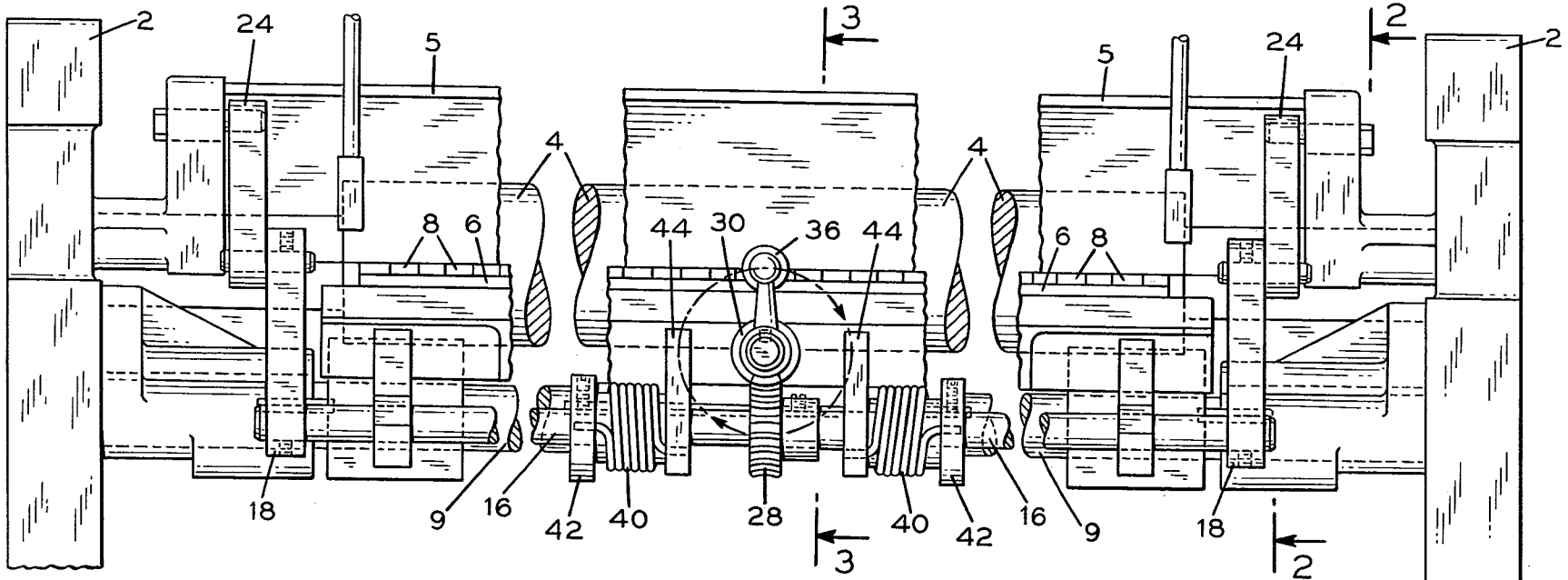
FIG. 1 is a transverse front view of the positioning mechanism taken along line 1—1 of FIG. 2, showing a segmented ink metering means.

As shown in the drawings there is a press frame 2 on which is mounted in suitable journals an ink fountain roller 4. There is a fountain blade 5 which with the fountain roller forms an ink trough 7.

The invention includes a metering means support block member 6 which is pivotally mounted with respect to the ink fountain roller on the press frame 2. The metering means segments 8 are mounted on the metering means support block member 6 and can be moved into and out of position adjacent the fountain roller. The metering means 8 can be either the continuous type or the segmental type. The metering means support block 6 and the metering means structure extend along the length of the press and the length of the fountain roller 4. The metering means supporting block 6 includes an offset portion 6A which is pivotally connected to a pivot bar 9 forming part of the press frame.

One of the features of this invention is that the metering means support block 6 and the metering means segments 8 are directly positioned with respect to the fountain roller 4 rather than, as is the case with certain prior art structures, positioned with respect to the press frame which in turn is positioned with respect to the fountain roller. The direct positioning of the metering means with respect to the fountain roller eliminates one possible source of error and results in increased accuracy.

Figure 3:
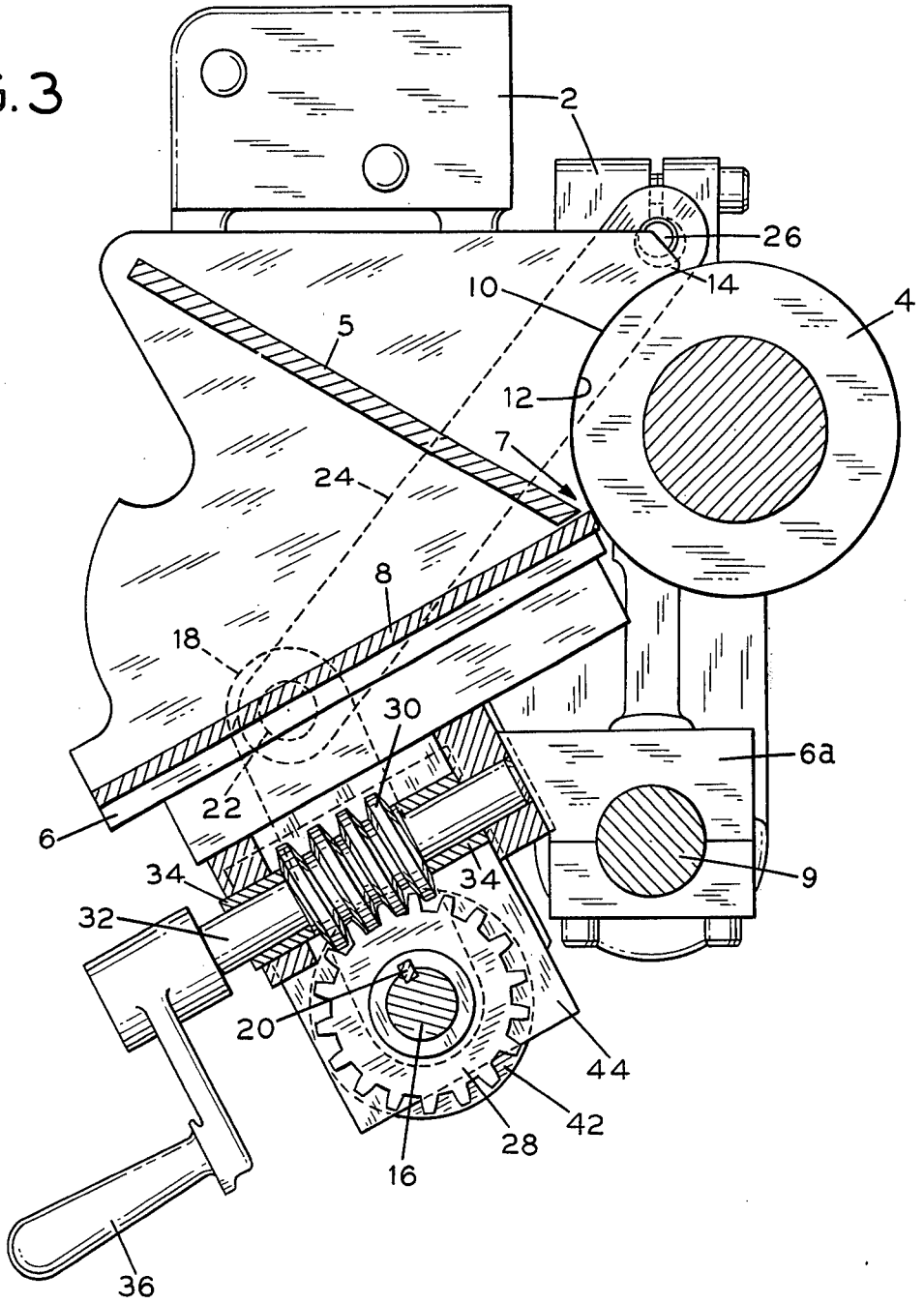
FIG. 3 is a vertical section, showing a segmented metering means taken along line 3—3 of FIG. 1 with the handle shown rotated 180°.

The direct positioning of the metering means with respect to the fountain roller is accompanied by stop means 10 on the metering blade support block 6 which is adapted to engage the fountain roller when the metering blade support block is moved to a position adjacent to the fountain roller (FIG. 3). Conveniently, the stop means may be in the form of curved portions or cheeks 12 on the support block having a curvature which matches the curvature of the fountain roller. The curved portions or cheeks 12 may conveniently be made of hardened steel or plated with some material such as chromium so as to reduce friction between the cheeks and the fountain roller.

Since the metering means is precisely positioned on the support block it will be precisely positioned with respect to the fountain roller by the stop means on the support block.

The leading edge of the curved surfaces or cheeks 12 is tapered or wedge shaped as shown at 14 to prevent an ink film build-up between the cheeks and the ink fountain roller.

The invention includes means for moving the metering means support block into and out of adjacent position with respect to the ink fountain roller.

As embodied, this means includes a torsion bar 16 which is parallel to and extends substantially along the length of the ink fountain roller.

A first lever means 18 is keyed by key 20 to each end of the torsion bar 16. The first lever means is pivotally connected at 22 to a second lever means 24. The other end of the second lever means is pivotally attached to the press frame at 26.

Mounted on the torsion bar is a worm gear 28. The worm gear is in meshed relationship with a worm 30 mounted on a shaft 32. The shaft is positioned by the bearings 34. At one end of the shaft is a handle 36 for turning the shaft 34. To take up backlash in the worm 30 there are torsion springs 40 which are attached to the torsion bar 16 through the annular rings 42. The other ends of springs 40 are attached to the support block through member 44. This feature is optional but when used takes up backlash in the worm during its return movement and prevents a sudden jerky return movement of the support block and associated structure.

Figure 2:
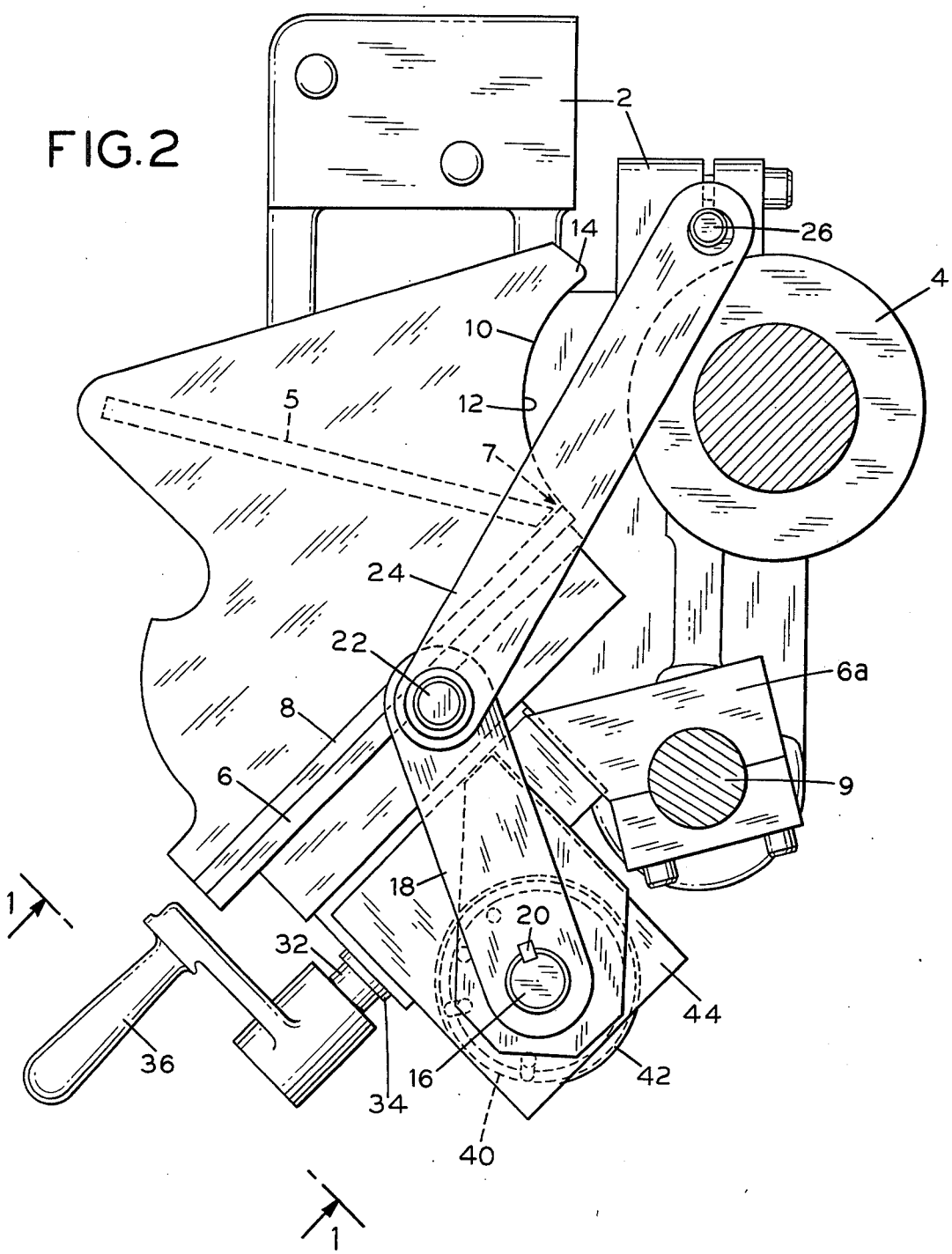
FIG. 2 is a side view of the positioning mechanism taken generally along line 2—2 of FIG. 1, showing a segmented ink metering means.

Rotation of the handle will cause rotation of the worm, worm gear and the torsion bar 16. Since the first lever means 18 is keyed to the torsion bar 16 the first lever rotates causing the pivotal connection between the first and second lever means to move resulting in the entire metering means support block 6 pivoting about the pivot bar 9 on the press frame. The handle is turned until the curved portion or cheeks 12 engage the fountain roller. This movement is shown by the differences in position between FIGS. 2 and 3. After the cheeks 12 are in contact with the fountain roller the handle 36 is turned until the proper amount of torque is thereby applied to the torsion bar thus providing a force which maintains the cheeks in contact with the fountain roller. This arrangement will cause the edge of the metering means to maintain a constant distance from the fountain roller even though the fountain roller may be slightly eccentric or have other manufacturing imperfections such as journal tolerances etc.

What is claimed is:

1. A positioning assembly on a press frame for positioning an ink metering means with respect to an ink fountain roller comprising:

(a) a metering means mounting block having an ink metering means with an ink metering edge mounted thereon;

(b) means for mounting said mounting block for movement on said press frame to and from a position adjacent the ink fountain roller;

(c) stop means on said mounting block for directly engaging said ink fountain roller to position said ink metering edge with respect to said ink fountain roller;

(d) positioning means for moving said mounting block with respect to said press frame;

(e) said positioning means including means for resiliently maintaining said stop means in engagement with said ink fountain roller so that said ink metering edge is maintained a constant distance from said ink fountain roller despite eccentricities or manufacturing imperfections in said ink fountain roller or the mounting thereof.

2. An assembly as defined in claim 1 wherein said stop means which directly engages said ink fountain roller includes a curved portion conforming to the curvature of said ink fountain roller.

3. An assembly as defined in claim 2 wherein said means for resiliently maintaining said stop means in engagement with said ink fountain roller includes a torsion shaft.

4. An assembly as defined in claim 3 wherein said positioning means includes a worm gear mounted on said torsion shaft which is in engagement with a worm.

5. A positioning assembly on a press frame for positioning an ink metering means with respect to an ink fountain roller comprising:

(a) a metering means mounting block;

(b) ink metering edge means mounted on said metering means mounting block;

(c) means for pivotally mounting said mounting block with respect to said ink fountain roller;

(d) means for causing pivotal movement of said mounting block so as to move said metering edge means towards and away from said ink fountain roller;

(e) stop means on said mounting block for directly engaging said ink fountain roller to position said ink metering edge means with respect to said ink fountain roller;

(f) said means for causing pivotal movement of said mounting block including a torsion bar which constantly urges said metering edge means towards said ink fountain roller and causes said metering edge means to be maintained a constant distance from said ink fountain roller despite eccentricities or manufacturing imperfections in said ink fountain roller or the mounting thereof.

6. An assembly as defined in claim 5 having:

(a) a worm gear mounted on said torsion shaft and a worm in operative engagement with said worm gear;

(b) first lever means keyed to said torsion shaft and a second lever means pivotally attached to said first lever means and to said press; and (c) torsion spring means surrounding said torsion bar arranged so as to prevent backlash in said worm.

* * * * *